United States Patent [19]

McQuade

[11] Patent Number: 4,919,463

[45] Date of Patent: Apr. 24, 1990

[54] GATE LOCKING DEVICE

[76] Inventor: Donald E. McQuade, 56 Jefferson St., Red Bank, N.J. 07701

[21] Appl. No.: 310,349

[22] Filed: Feb. 13, 1989

[51] Int. Cl.[5] ..... E05C 19/10

[52] U.S. Cl. ..... 292/120; 292/218; 292/106; 70/137

[58] Field of Search ..... 292/104, 116, 106, 120, 292/218, 238, DIG. 13, 205, 56, 68; 70/137

[56] References Cited

U.S. PATENT DOCUMENTS

| | | | |
|---|---|---|---|
| 277,879 | 5/1883 | Burkhardt | 292/205 |
| 660,656 | 10/1900 | Pries et al. | 292/104 |
| 944,360 | 12/1909 | Gregson | 292/120 |
| 1,068,466 | 7/1913 | Underwood | 292/116 X |
| 1,696,785 | 12/1928 | Welty | 292/205 |
| 3,698,752 | 10/1972 | Edwards et al. | 292/205 X |
| 3,871,134 | 3/1975 | Lening | 292/238 X |
| 3,877,738 | 4/1975 | Nelson | 292/68 |
| 4,082,077 | 4/1978 | Marfatia et al. | 292/120 X |
| 4,581,907 | 4/1986 | Eberly | 292/205 X |
| 4,618,175 | 10/1986 | Smith | 292/238 X |

*Primary Examiner*—Gary L. Smith
*Assistant Examiner*—Michael Milano
*Attorney, Agent, or Firm*—Weingram & Zall

[57] ABSTRACT

A gate latch for a chain link fence comprising a collar for mounting on a first portion of a gate; an oar lock latch for pivotal mounting on a second portion of a gate, the oar lock having means formed thereon to lock the oar lock to the collar. A means is also provided which is formed on the collar for interfitting with the locking means and for enclosing a portion of the oar lock to lock the oar lock to the collar and inhibit access to the enclosed portions of the oar lock.

8 Claims, 2 Drawing Sheets

FIG-2
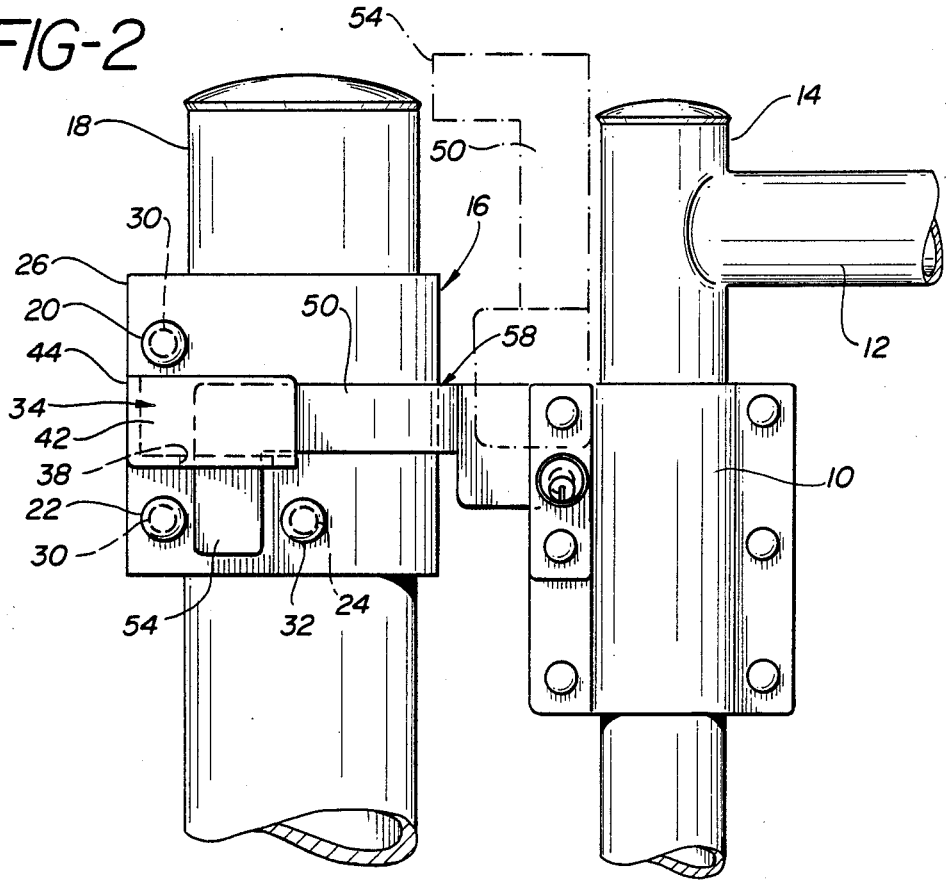
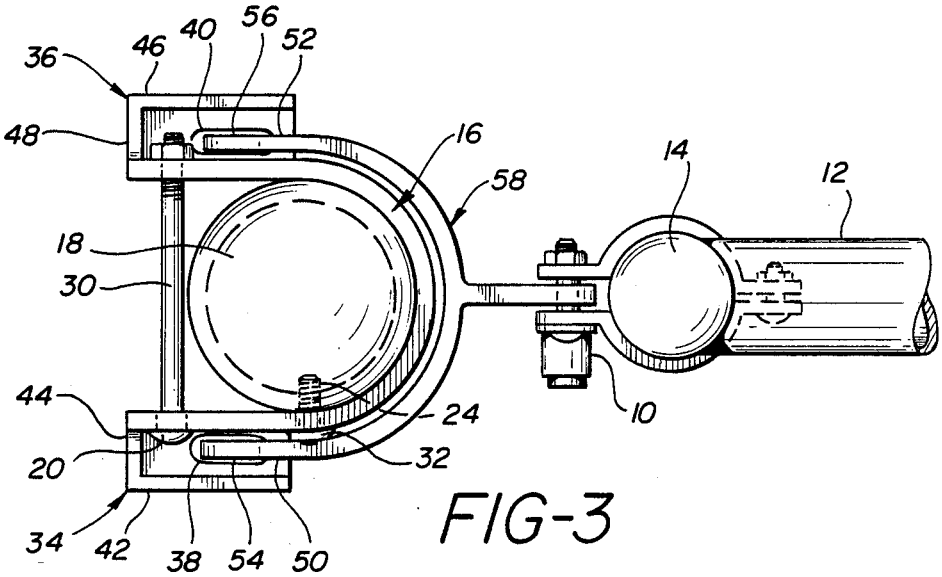
FIG-3

GATE LOCKING DEVICE

BACKGROUND OF THE INVENTION

1. Field of the Invention

This invention relates to a high security latch for a gate lock for a chain link fence.

2. Prior Art

Chain link fences are well known. Typically such fences are made of a support frame of pipe which supports a mesh of thick metal wire which forms a screen. The screen is secured to the frame by pieces of wire which surround the frame work and mesh at fixed intervals. To provide a gate in an opening formed by pipe and/or poles of a chain link fence, a pipe frame the size of the opening is hinged to a pipe on one side of the opening. Typically, an oar lock or fork latch is hingeably attached to the opposite side of the gate frame. When the gate is in the closed position, the oar lock or fork latch is moved to the horizontal position where it receives a pole of the fence in the U-shaped portion thereof.

Typically, to lock the gate openings are provided in the oar lock and the collar holding the oar lock to the gate. When the oar lock is in the closed position, i.e. horizontal, the openings in the lock and collar line up and a padlock is passed through the openings to lock them in their aligned position. With the lock in place, the oar lock cannot be moved from the horizontal closed position to the vertical open position. Thus the gate is locked.

The drawback of such a method of locking a chain link gate includes difficulty in opening and closing the lock and gate, the potential to lose or misplace the lock and the inherent weakness of an oar lock or fork latch to tampering by an intruder. Loss of the lock occurs frequently because the padlock has to be removed from the gate to complete the locking and unlocking operation. Further, in order to unlock the gate two hands must be used, one hand to hold and steady the lock and another hand for inserting the key to open the lock.

U.S. Pat. No. 4,691,541 to the inventor herein (McQuade), issued Sept. 8, 1987, eliminates the risk of losing or misplacing the lock because the locking device is always attached to the gate frame. At no time is the lock removed from the gate to complete its operation. Operational ease is attained because the lock is stationary and the key slot is accessible. To open the lock all that is necessary is to insert the key and turn. When the key is turned, the lock cylinder will pop out and release the lock bar from the oar lock. To lock the gate, the oar lock is merely moved to its horizontal, locking position and a push button cylinder is engaged to move its lock bar into an opening in the oar lock to fix the oar lock in position.

In McQuade the collar holding the lock and oar lock is modified from that typically used to retain an oar lock. The collar is in two pieces and sandwiches the pipe of the gate frame. Set screws/bolts pass through the collar causing the collar to engage the frame pipe. The lock system is comprised of several parts. Each of the parts is easily replaceable permitting quick and easy repair to the system. The lock provides a child proof gate lock with ease of installation. The lock is always in its proper locking position and cannot be misplaced.

A major problem remaining, not addressed by McQuade, inherent in the use of an oar lock or fork latch device for locking a gate, is that easy access can be obtained by an intruder. By simply prying the outside half of the fork outward, entry can be obtained. Double driveway gates are similarly easily opened by merely pushing hard enough on the gate. Such is often accomplished by a mere gust of wind.

Other gate latches of the prior art do not solve this foregoing problem. For example, by Youngworth, U.S. Pat. No. 2,666,660, and by Lening et al, U.S. Pat. No. 4,387,916. These gate latches all employ oar locks of generally standard configuration. Access to the oar lock is not protected and the oar lock itself is not locked to the gate pole to which it is connected.

The interlocking of the gate poles of chain link fences is found in the dual locking device of Joersz, U.S. Pat. No. 3,926,018. The Joersz invention, however, requires detachable dual clamps tightly clamping one pole to the other.

Other latch and lock devices are described in the following patents:

U.S. Pat. No. 4,592,578 to Martin;
U.S. Pat. No. 3,934,436 to Candlin et al;
U.S. Pat. No. 3,702,549 to Solovieff et al;
U.S. Pat. No. 3,307,384 to Sinervo;
U.S. Pat. No. 3,270,536 to Sprung;
U.S. Pat. No. 3,083,561 to Sussing;
U.S. Pat. No. 3,042,435 to Wiesler;
U.S. Pat. No. 2,809,063 to Taylor;
U.S. Pat. No. 2,074,759 to Richards;
U.S. Pat. No. 2,194,408 to Sluss;
U.S. Pat. No. 1,319,187 to Sumners;
U.S. Pat. No. 1,179,852 to Louden;
U.S. Pat. No. 303,225 to Jordan; and
French Pat. No. 584,589 to Hutin.

None of these references teach or suggest the claimed gate locking device of this invention and the benefits derived therefrom.

SUMMARY OF THE INVENTION

The security provided by the invention of the aforementioned U.S. Pat. No. 4,691,541 to McQuade, as well as other gate locks employing an oar lock type of locking member is enhanced by use of the present invention. It should be understood that while the present invention is disclosed in association with the device disclosed and claimed in the aforementioned U.S. Pat. No. 4,691,541 to McQuade, it is readily apparent that this invention can be utilized separate and apart from the self-locking mechanism described therein. In fact, the present invention can be utilized with any existing oar lock type of gate locking arrangement.

The present invention includes an oar lock and oar lock receptacle designed for cooperation with each other. The oar lock is formed as a stirrup having two downwardly extending vertical tab portions affixed to respective ends of the oar lock stirrup portion. These extending tab portions interfit within slots in supporting housings designed to receive the ends of the oar lock stirrups therein. The housings are mounted on a collar which is affixed to the pole of the fence which the oar lock stirrup surrounds.

Thus, the present invention is a new and innovative construction of a support member and oar lock fixture which together heightens the degree of security provided by a gate lock of the type disclosed and claimed in the aforementioned U.S. Pat. No. 4,691,541 to McQuade, by increasing the supporting strengths of the elements on the pole of the fence to which the standard oar lock is removably affixed, providing security for that connection by shielding the portions of the oar lock from access and by providing tab fixtures to enhance the strength and integrity of the connection between the oar lock and the fixture mounted on the fence pole.

The present invention secures the gate to the gate latch post. In the case of a double driveway gate, the invention locks both halves of the gate frame together. The present invention prevents prying any portion of the oar lock outward or upward; and in double driveway gates, the oar lock cannot be twisted out of engagement by pushing on the gate or by the force of a gust of wind.

BRIEF DESCRIPTION OF THE DRAWINGS

FIG. 2 is a side view of the invention; and

FIG. 3 is a top view of the invention.

DESCRIPTION OF THE PREFERRED EMBODIMENT

Figure 1:
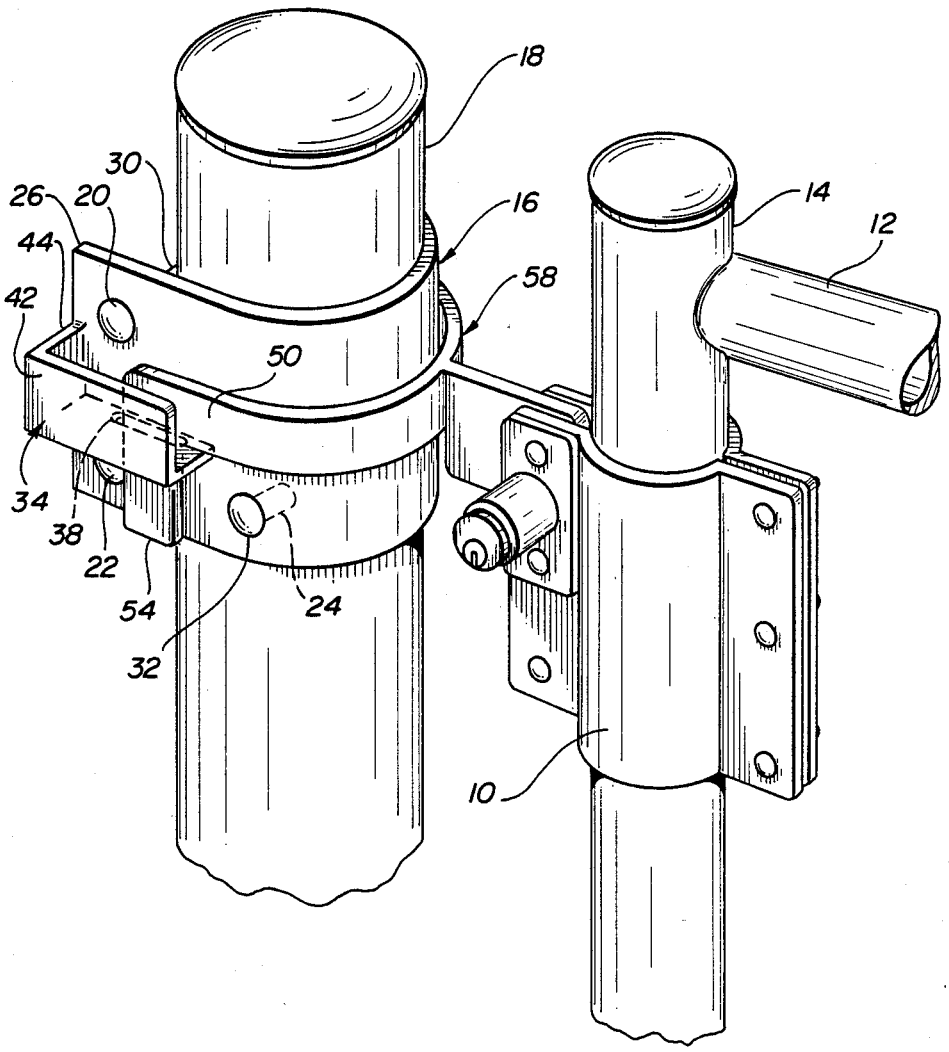
FIG. 1 is a front perspective view of the device of the invention.

As shown in FIGS. 1, 2 and 3, numeral 10 denotes generally, the gate lock disclosed and claimed in the aforementioned U.S. Pat. No. 4,691,541 to McQuade which is incorporated herein by reference. The lock 10 is mounted on gate pipes 14. However, the present invention does not require the locking arrangement described in McQuade. The present invention is usable with any gate lock arrangement provided the gate lock employs an oar lock or fork latch of the general type shown in McQuade. Oar locks of this type are well known in the art.

The present invention as shown in FIGS. 1, 2 and 3 includes a "U" shaped collar 16 which is mounted on and surrounds a gate pipe 18. Collar fixture 6 has bolt apertures 20 and 22 formed therein and also has a threaded screw aperture 24 formed therein. Bolt apertures 20 and 22 permit the end portions 26 and 28 of collar 16 to be bolted one to the other (a bolt 30 is shown in FIG. 3). The threaded screw aperture 24 permits additional security by tightening a screw 32, shown in FIG. 3, in aperture 24, preferably into gate pipe 18, to further secure the collar 16 to pipe 18.

Collar 16, thus secured to the gate pipe 18, has two housings 34 and 36 formed at opposite ends of the collar 16. These housing portions, 34 and 36, each have a bottom surface which contains an apertured slots 38 and 40 respectively, therein. Two pairs of side walls (42, 44 in housing 34, and 46, 48 in housing 36) are provided to complete the housing.

The apertures 38 and 40 and the side walls of the housings 34 and 36 cooperate with and partially enclose the sides 50 and 52 of oar lock 58 and tab portions 54 and 56 formed on said sides.

More specifically, the oar lock 58 is formed of a shape complementary to the shape of collar 16. Extended tabs 54 and 56 are found at each of the ends of the sides 50 and 52 of the oar lock 58. Only one such tab 54 is shown in FIGS. 1 and 2. The tab 54 is formed on the end of side 50 of the oar lock 58 and a corresponding tab 56 is formed on the end of side 52 of oar lock 58. The tabs 54 and 56 interfit into slots 38 and 40, respectively, in the bottom surface of the housings 34 and 36.

As will now be apparent, the security afforded at the gate lock pipe 18 by the collar fixture 16 and the tabbed oar lock 58 is greatly enhanced over that customarily employed in the prior art as represented by the oar lock 14 in U.S. Pat. No. 4,691,541 to McQuade. First, the application of force and pressure on the gate in an attempt to loosen the lock by enabling the oar lock 58 to twist out of engagement with the pipe 18 is inhibited by tabs 54 and 56 interfitting into slots 38 and 40 within bottom surface of protective housings 34 and 36. Further, the tabs 54 and 56 interfit within the slots 38 and 40 and the side walls of the housings 34 and 36 and inhibit the ability of the oar lock to be twisted out of engagement with the gate pipe 14.

Secondly, the side walls 42, 44 and 46, 48 of the housings 34 and 36 also inhibit access to the point of connection of the tabs 54 and 56 on the oar lock 58 within the slots 38 and 40 of the housings 34 and 36. Any attempt to utilize a screw driver or other tool to gain leverage by forcing the screw driver or tool into the top of the housings 34 or 36 to force the screw driver underneath the oar lock 58 and thereby out of the slots 38 and 40, is impossible by virtue of the protective surfaces provided by the side walls 42, 44 and 46, 48.

Thirdly, attempts to bend an arm of the oar lock 58 to widen the opening in the oar lock 58 will be frustrated by the walls of the protective housings 34 and 36 surrounding the sides 50 and 52 of the oar lock.

What is claimed:

1. A gate locking device for connection between first and second pipes in a gate closure comprising:

a U-shaped collar having two connecting arms secured to the first pipe;

a housing formed on one of the connecting arms, the housing having an aperture formed therein;

an oar lock hingeably attached to the second pipe movable between a first position where the pipes are unlocked and a second position where the pipes are locked, the oar lock having a portion formed therein for interfitting into the aperture when the oar lock is in the locked position.

2. A combination for securing an oar lock hinge closure to a gate comprising:

a collar for mounting on a first portion of the gate to be closed, the collar having first and second housing portions formed thereon, the housing portions each having an aperture formed therein;

an oar lock for mounting on a second portion of the gate to be closed, the oar lock having first and second extended portions for interfitting within the apertures of the housings, when the oar lock is in its closed position.

3. The combination of claim 2 wherein the oar lock is U-shaped having first and second arms formed as either side of the "U"; the extended portions being formed adjacent the ends of each of the arms and extending angularly from the arms.

4. The combination of claim 3 wherein the collar is U-shaped, the arms surrounding the collar when the oar lock is in its closed position.

5. A locking arrangement for a gate lock of the oar lock type comprising:

a U-shaped oar lock having first and second arms formed thereon, the oar lock being hingeably secured to a first portion of the gate to be locked;

housing means attached to a second portion of the gate to be locked having a bottom surface and a rigid outer portion defining a substantially enclosed area for receiving the arms of the oar lock and substantially enclosing the arms to inhibit and limit downward and sideward movement of the arm portions.

6. The locking arrangement of claim 5 wherein:

the arms of the oar lock include extension means formed integrally with the arms for interfitting in an aperture in the bottom surface of the housing means for receiving the extension means to further secure the oar lock to the first means to limit and inhibit movement of the arm portion within the aperture.

7. A gate locking device for connection between first and second pipes in a gate closure comprising:

a collar secured to a first portion of a gate closure;

a housing formed on the collar, the housing having an aperture formed therein;

a two armed U-shaped member oar lock, hingeably secured to a second portion of a gate closure and having a portion formed thereon for interfitting into the aperture to secure the collar and the oar lock.

8. A device for securing an oar lock hinge gate closure comprising:

a collar means for mounting on a first portion of a gate; the collar having first and second housing portions formed thereon, the housing portions each having an aperture formed therein; first and second extended portions of the oar lock interfitting within the housings and the apertures for securing the oar lock.

* * * * *